US006521095B1

(12) United States Patent
Bonander

(10) Patent No.: US 6,521,095 B1
(45) Date of Patent: Feb. 18, 2003

(54) COMPOSITE VANE HINGE IN A HEADBOX

(75) Inventor: James S. Bonander, Greentown, PA (US)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/068,538

(22) Filed: Feb. 5, 2002

(51) Int. Cl.[7] ..... D21F 1/02
(52) U.S. Cl. ..... 162/343; 162/344
(58) Field of Search ..... 162/336, 343, 162/347, 344

(56) References Cited

U.S. PATENT DOCUMENTS

| | | | |
|---|---|---|---|
| 3,888,729 | A | 6/1975 | Parker et al. |
| 3,939,037 | A | 2/1976 | Hill |
| 4,128,455 | A | 12/1978 | Justus |
| 4,133,715 | A | 1/1979 | Hergert |
| 4,566,945 | A | 1/1986 | Ewald et al. |
| 4,617,091 | A | 10/1986 | Rodal et al. |
| 4,812,209 | A | 3/1989 | Kinzler et al. |
| 4,824,524 | A | 4/1989 | Hildebrand |
| 4,891,100 | A | 1/1990 | Hildebrand |
| 4,941,950 | A | 7/1990 | Sanford |
| 5,013,406 | A | 5/1991 | Hergert |
| 5,545,294 | A | 8/1996 | Linden et al. |
| 5,820,734 | A | 10/1998 | Pantaleo et al. |
| 6,165,324 | A | 12/2000 | Linden |

FOREIGN PATENT DOCUMENTS

| | | |
|---|---|---|
| CA | 2325878 | 3/1998 |
| CA | 2325990 | 3/1998 |

*Primary Examiner*—Karen M. Hastings
(74) *Attorney, Agent, or Firm*—Lathrop & Clark LLP

(57) ABSTRACT

A bracket of graphite epoxy has a cylindrical portion which hingedly fits within a dovetail groove extending in the machine direction across the injection face of a papermaking headbox. The bracket has downstream portions defining a vane-receiving slot which receives a plastic sheet vane which is held by screws. The bracket is laid up of carbon fibers oriented so that the coefficient of thermal expansion matches the steel from which the headbox is manufactured. A two-part metal mold is used to define the underside and the bead portion of the bracket. A rubber gasket of Shore 70 material forms the center of the bead portion about which prepregs of graphite cloth are wrapped. A removable polytetrafluoroethylene insert defines the slot during molding. The assembly is placed under a vacuum bag and heated, causing the rubber gasket to expand and press the overlying graphite prepregs against the sides of the mold.

10 Claims, 2 Drawing Sheets

COMPOSITE VANE HINGE IN A HEADBOX

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to papermaking headboxes in general, and in particular to vanes or headbox trailing elements which are used to divide the flow of stock in a slice. The headbox of a papermaking machine injects a stream of paper forming stock onto a moving forming fabric or between twin forming fabrics in the forming section of the papermaking machine. In the modem papermaking machine the forming fabric or wire may be moving in excess of 6,000 feet per minute. Moreover, the forming fabric, sometimes referred to as a forming wire, may be more than 400 inches wide. Thus the jet of water must exit the headbox as a sheet of water containing pulp moving approximately 100 feet per second and more than 30 feet wide. Great uniformity across the sheet of paper, and along the direction in which the paper is formed is required. The headbox functions to provide a uniform flow of stock, and to accelerate the stock through a slice to form a jet which is emitted from the lip of the slice. Paper fibers suspended in water have a tendency to come together in clumps, with highly undesirable effects on the uniformity of the paper web formed. Various hydraulic structures located within the headbox are designed to create turbulence to prevent clumping or flock creation. Vanes within the headbox, i.e., flexible plastic sheets extending from the headbox injection wall to near the slice outlet, provide small-scale turbulence which prevents the formation of flocks.

As a result of wear or accident, the plastic vanes require periodic replacement, and thus recurring cost is a significant concern. The vane plastic sheet may be formed of polycarbonate, Hylar® PVDF fluoropolymers, graphite composite, or glass fiber composite, and is attached to a bracket which pivotally mounts the plastic sheet to the injection face of the headbox. The bracket has cylindrical portions that fit within a dovetail groove machined into the injection face of the headbox.

Forming a vane with a bead increases the complexity and cost of fabricating the vane. An added complication is presented in headboxes where the injection wall is not perpendicular to the jet formed at the outlet of the slice. In such a case it is necessary to form an angle at the transition between the retaining bead and the vane which lies generally parallel to the jet. One approach to mounting vanes within a headbox has employed a hinge bracket which is hingedly mounted within the groove in the injection face and connects to an essentially planar vane. The prior art includes a bronze bracket which functions satisfactorily, but has a high initial cost. Thermal expansion is also a concern because the temperature of the stock is at times varied, and bronze has a relatively fixed coefficient of thermal expansion. The bronze bracket must be machined from expensive bronze stock resulting in considerable cost. The cost of the bronze bracket necessitates that the bronze brackets be reused.

Considerable expense can be involved in returning to the factory bronze brackets which may be more than thirty feet long.

What is needed is a vane hinge bracket which is low-cost and which has tailorable thermal expansion properties.

SUMMARY OF THE INVENTION

The vane hinge bracket of this invention is composed of graphite epoxy, and has a cylindrical portion which hingedly fits within a dovetail groove which extends in the cross machine direction across the injection face of a papermaking headbox. The vane hinge bracket has downstream portions forming a vane receiving slot, with a plastic sheet forming the vane positioned within the receiving slot. The plastic vane is held within the receiving slot by a plurality of metal screws which extend perpendicularly through holes formed in the plastic sheet and perpendicular to the slot formed on the downstream side of the vane hinge bracket. The metal screws extend through holes formed in the portions of the vane hinge bracket which define the slot. A web of material extends between the downstream portions and the cylindrical portions, the web may be curved so as to hold a vane an angle with respect to the injection face, or may be straight.

The vane hinge bracket is laid up of carbon fibers oriented so that the coefficient of thermal expansion matches the steel from which the headbox is manufactured. A two-part metal mold is used to define the underside and the bead portion of the bracket, a rubber gasket of Shore 70 material forms the center of the bead portion about which prepregs of graphite cloth are wrapped. A slot is formed by a polytetrafluoroethylene insert which is removed once the vane hinge bracket is cured. The two-part mold containing the prepregs, the rubber cord, and the Polytetrafluoroethylene insert are placed under a vacuum bag and the two-part mold is heated. Heating the mold causes the rubber cord to expand, pressing the overlying graphite prepregs against the sides of the mold. By proper orientation of the fibers, the thermal expansion can be matched to the steel from which the headbox is formed with a linear coefficient of thermal expansion of about 6.5 ppm per degree Fahrenheit.

It is a feature of the present invention to provide a hinge bracket for mounting a vane in a headbox which is of lower cost.

It is a further feature of the present invention to provide a hinge bracket with a coefficient of thermal expansion which can be tailored.

It is yet another feature of the present invention to provide a hinge bracket for mounting a vane in a headbox with a simplified attachment means.

It is another feature of the present invention to provide a method of manufacturing a hinge bracket for mounting a vane in to a headbox.

Further objects, features and advantages of the invention will be apparent from the following detailed description when taken in conjunction with the accompanying drawings.

DESCRIPTION OF THE PREFERRED EMBODIMENTS

Figure 1:
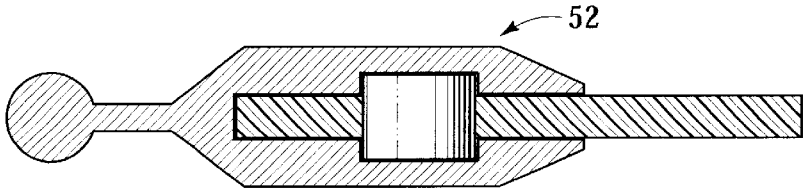
Fig.1 (PRIOR ART)
FIG. 1 is a side elevational cross-sectional view of a bronze prior art hinge bracket for mounting a vane in a headbox.
Figure 2:
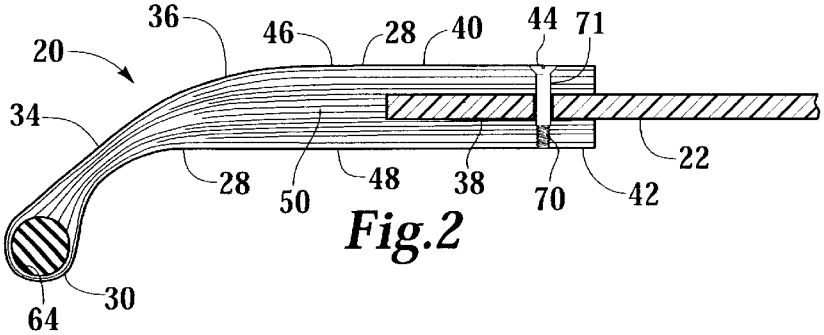
FIG. 2 is a side elevational cross-sectional view of the graphite composite hinge bracket of this invention.
Figure 4:
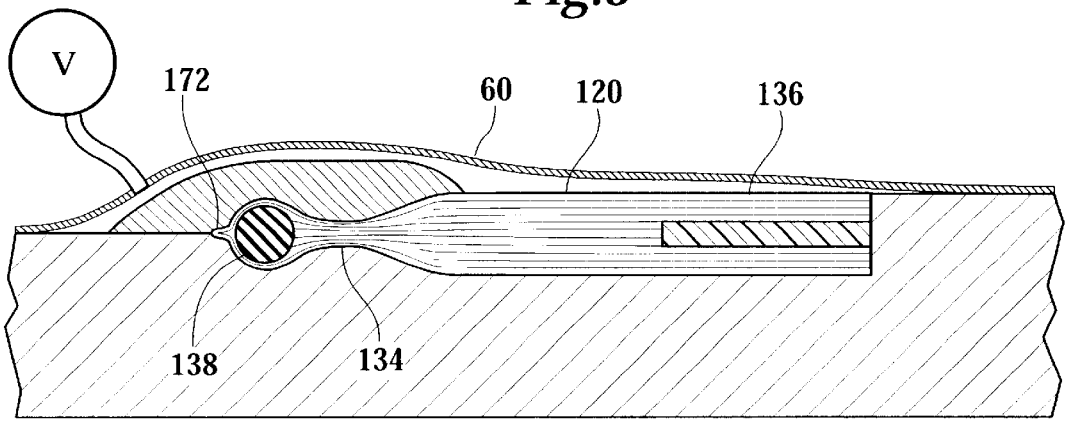
FIG. 4 is a side elevational cross-sectional view of an alternative embodiment of the hinge bracket of this invention positioned within a mold.
Figure 5:
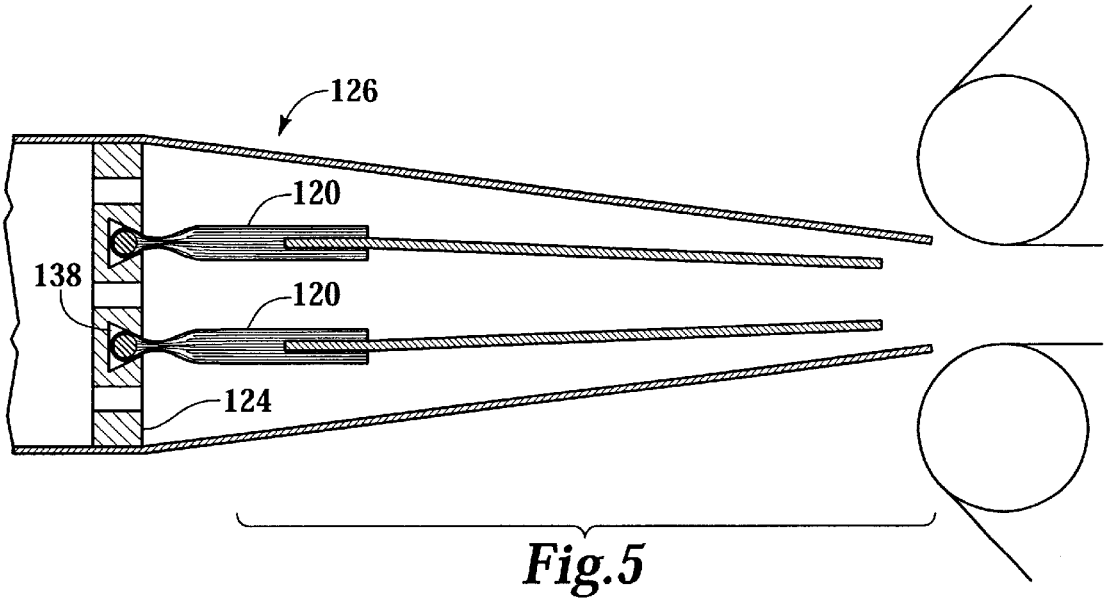
FIG. 5 is a schematic side elevational view of the hinge bracket of FIG. 2 positioned for use within a headbox.
Figure 6:
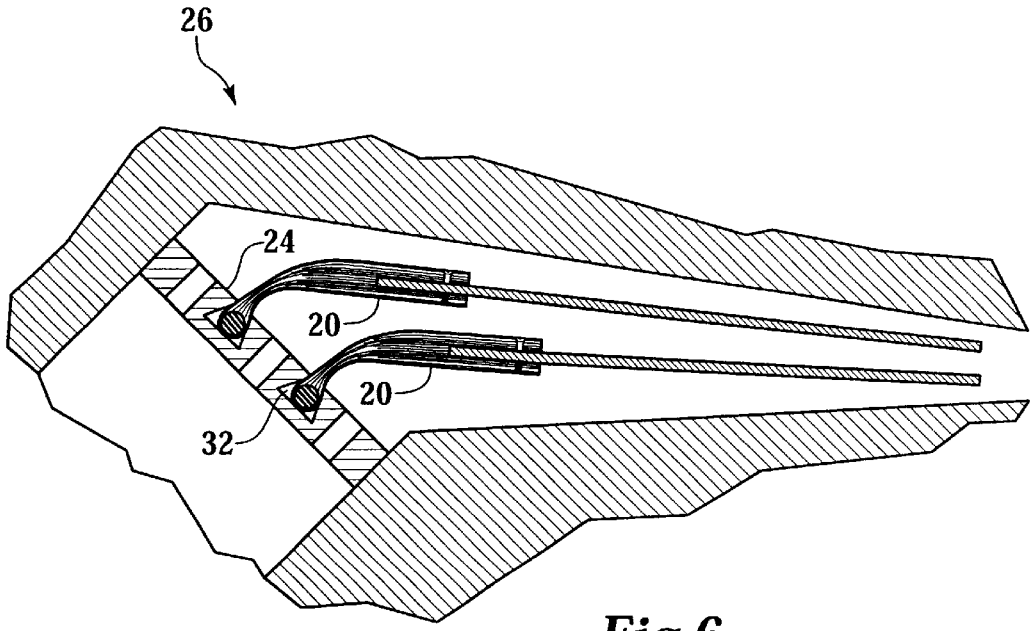
FIG. 6 is a schematic side elevational view of the alternative embodiment hinge bracket of FIG. 4 positioned for use within a headbox.

Referring more particularly to FIGS. 1–6, wherein like numbers refer to similar parts, a hinge bracket 20 is shown in FIG. 2 for mounting a vane 22 to the discharge wall 24 of the headbox 26 as shown in FIG. 6 The hinge bracket 20 is constructed of graphite cloth layers 28 bonded together by an epoxy matrix. The hinge bracket 20 extends the entire width in the cross machine direction of the headbox discharge wall 24.

The hinge bracket 20 has a bead portion 30 which is captured within a dovetail-shaped groove 32 in the face of the discharge wall 24. Extending from the bead 30 is a web 34 which connects the bead 30 to a body portion 36 of the bracket 20. The body portion 36 has a slot 38 defined between an upper flange 40 and a lower flange 42. The vane 22 is mounted within the slot 38 by a plurality of closely spaced fasteners 44, particularly screws which penetrate the upper flange 40, the vane 22 and the lower flange 40 to as shown in FIG. 2. The graphite cloth layers 28 are arranged as shown in FIG. 2 with upper layers 46 forming part of the upper flange 40 extending to and wrapping about at least a portion of the bead 30. Similarly, lower layers 48 extend to and wrap around at least a portion of the bead 30. Additional layers of cloth 50 are positioned between the upper layers 46 and the lower layers 48 to facilitate forming the slot 38.

Graphite fibers have several unique properties. In addition to their extremely high tensile strength and high modulus of elasticity, graphite fibers have a slightly negative coefficient of thermal expansion in the direction along the fibers, and a relatively high coefficient of thermal expansion transverse to the fibers. The result is that by controlling the orientation of the fibers, it is possible to engineer a specific coefficient of thermal expansion into a composite part. Fiber orientation is typically controlled by laying up various layers of cloth with specifically designed fiber orientations. In particular, a part with zero coefficient of thermal expansion can be developed by laying alternate layers of fibers at an angle of 17 degrees to each other. Similarly, it is possible to match the thermal expansion of steel such as used in the fabrication of headboxes, which is about 6.5 ppm per degree Fahrenheit, by balancing fiber direction so that alternative layers of fiber are oriented 45 degrees apart.

Forming vanes of fiber composites including graphite are well known, see for example U.S. Pat. Nos. 5,820,734; 5,013,406; 4,617,091; and 4,566,945 each of which is incorporated herein by reference. A vane constructed from graphite epoxy can thus be matched to the expansion of the vane hinge bracket 20. The construction of a graphite composite vane bracket 20 with a thermal expansion which matches the thermal expansion of the headbox, together with a vane 22 with similar thermal expansion properties, allows tight tolerances between the hinge bracket 20, the vane 22, and the structure of the headbox 26.

The manufacture of paper commercially requires the use of a suspension of fibers in water. Various additives and modifications to the fibers are the tools of the paper manufacturing engineer, one additional important controllable variable is the viscosity of the water which can be controlled by adjusting the water temperature. Therefore paper is often formed using heated water, to obtain lower water viscosity. The use of heated water, if it results in interferences or gaps forming between the parts of the headbox, particularly between the headbox pond side walls and the hinge bracket 20 and the vane 22, produces the formation of undesirable fiber clumps, or flow disturbances. Flow disturbances or fiber clumps reduce the quality of the paper formed.

Cost is also an important consideration in the manufacture of hinge brackets and vanes both may require periodically replaced either due to wear or due to damage such as caused by improper startup or shutdown of the headbox. As shown in FIG. 1, a hinge bracket 52 constructed of bronze has been successfully utilized. However, bronze must be machined from available standard bar stock with the result that the relatively high cost of bronze is amplified by the low yield of the finished part. When four or more pounds of material are cut away for each pound of the final hinge bracket 52, the basic material cost of bronze is multiplied by a factor of five. This, when combined with the relatively high density of the bronze, makes material costs dominate in the production of bronze hinge brackets 52. On the other hand, graphite epoxy has over the years become relatively less costly, while the lightweight high-strength nature of the material requires substantially less material, thus the use of graphite composite results in considerable cost savings.

Figure 3:
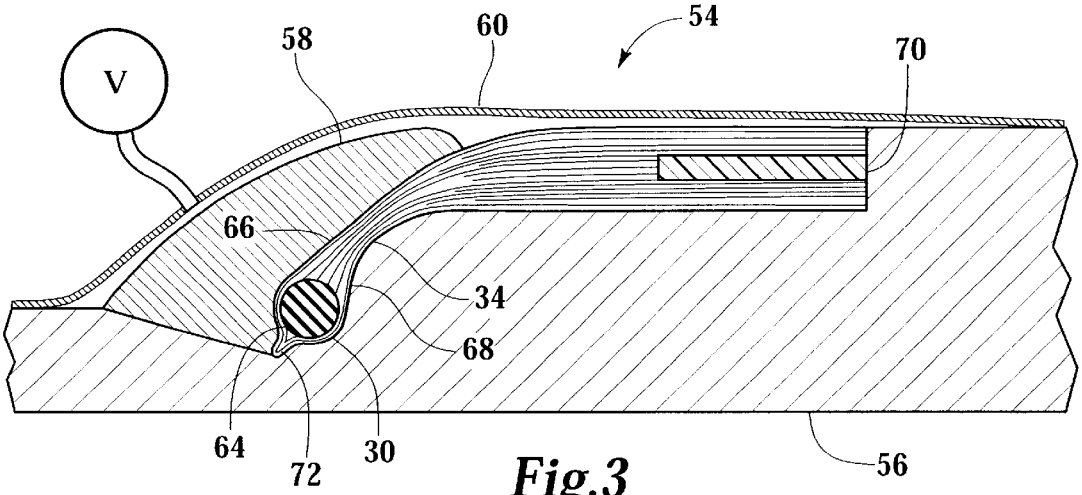
FIG. 3 is a side elevational cross-sectional view of the hinge bracket of FIG. 2 positioned within a mold used in forming the hinge bracket.

Manufacture of the hinge bracket 20 can be accomplished with little or no material waste, further adding to the economics of the bracket 20. As shown in FIG. 3, the hinge bracket 20 is manufactured in a simple mold 54 which has a constant cross-section. The mold has a lower mold piece 56 which is heated and an upper mold piece 58 which covers the bead portion 30 and web portion 34 of the part. A vacuum bag 60 covers the rest of the hinge bracket 20 and applies a clamping force to the upper mold piece 58 and the upper surface 62 of the bracket 20. A rubber gasket cord 64 of Shore 70 A is positioned in the center the bead portion 30, upon heating during the curing process the gasket cord 64 swells compressing the graphite layers 28 against the inside surface 66 of the upper mold and the inside surface 68 of the lower mold. While it is known to use expanding rubber in the molding of an attachment bead on an air vanes on jet fighter aircraft, applying the technique to vanes in a papermaking headbox is not known to have been previously attempted.

A polytetrafluoroethylene mold insert 70, as shown in FIG. 3, is used to form the slot 38 into wich the vane 22 is positioned. After the hinge bracket 20 is cured, the mold insert 70 is removed, holes 71 are drilled through the upper and lower flanges 40, 42 and screws 44 are fastened to attach the vane 22 to the hinge bracket 20. The angle at which the web portion 34 is bent depends on the particular design of the headbox but, as shown in FIG. 5, the angle is approximately one-hundred-and-thirty degrees.

The mold 54 is relatively easily constructed having a constant cross-section which allows its fabrication in the necessary length which often exceeds 300 inches. At the same time, the simple vacuum bagging technique applies an even load without mold distortion. For greater simplicity in lay up, prepregs materials will preferably be used. These materials consist of graphite cloth which has been wetted with catalyzed epoxy which is then stored at low-temperature until use. The prepregs cloth material, which may be precut to size, is laid up in the mold 54. The mold is closed, the vacuum bag is positioned and a vacuum is drawn on the bag and the mold, thus removing any trapped air and causing the compression of the prepregs within the mold. When the mold 56 is heated to the proper temperature, the epoxy contained in the prepregs is catalyzed, joining the layers 28 of cloth together to form the rigid final part 20. Heating the mold also causes the rubber rod 64 to expand, pressing layers 28 of prepregs against the mold surfaces. Because the prepregs are relatively stiff, the prepregs layers may be brought together to form a ridge 72 which is most distal from the vane slot and which is removed after the bracket 20 is removed from the mold.

FIG. 4 shows an alternative embodiment hinge bracket 120, in which the web 134 between the bead portion 130 and the body portion 136 is straight. Again, during the molding process a ridge 172 may be formed which is removed to form the bracket 120 as shown in FIG. 5. The hinge bracket 120 is pivotally mounted to a discharge wall 124 of the headbox 126, in the dovetail slot 138.

It should be understood that the webs 34, 134 of the hinge brackets 20,120 may be at various angles depending on the design of the headbox into which the hinge brackets 20, 128 are installed.

It should be understood that various fibers other then graphite could be used, including glass and KEVLAR ceramic fibers.

It should be understood that vanes can be manufactured from a variety of materials including Lexan® brand of polycarbonate, Hylar®, thermoplastic, composite or even metal.

It is understood that the invention is not limited to the particular construction and arrangement of parts herein illustrated and described, but embraces all such modified forms thereof as come within the scope of the following claims.

I claim:

1. A headbox incorporating a bracket for mounting a vane comprising:

a headbox having a discharge wall, through which stock is discharged into a slice chamber and through a slice opening;

a discharge wall having a plurality of cross machine direction extending grooves;

a rigid bracket having a bead portion pivotally mounted within one of said plurality of a cross machine direction extending groove;

internal to the bead portion an elastomeric rod shaped element;

a first plurality of cloth layers in a matrix extending about the elastomeric rod shaped element forming a web which is narrower than the bead and which extends from the one cross machine direction extending groove into the slice chamber; and a second plurality of cloth layers, in the matrix positioned between the first plurality of cloth layers, so that the first plurality of cloth layers and the second plurality of cloth layers define a vane receiving slot.

2. The apparatus of claim 1 wherein the first plurality of cloth layers, and the second plurality of cloth layers are graphite, and the matrix is epoxy.

3. The apparatus of claim 2 wherein the discharge wall has a first coefficient of thermal expansion, and the first plurality of cloth layers and the second plurality of cloth layers contain fibers oriented to produce a second coefficient of thermal expansion which is substantially identical to the first coefficient of thermal expansion.

4. The apparatus of claim 2 wherein the first coefficient of thermal expansion is about 6.5 ppm per degree Fahrenheit.

5. The apparatus of claim 1 wherein the web, the elastomeric rod, and the vane receiving slot, are centered about a common plane.

6. The apparatus of claim 1 wherein the rigid bracket has a first plurality of holes extending in a cross machine direction above the vane receiving slot and a second plurality of holes extending in a cross machine direction below the vane receiving slot, and a plurality of fasteners extend between the first plurality of holes and the second plurality of holes.

7. A headbox incorporating a bracket for mounting a vane comprising:

a headbox having a discharge wall, through which stock is discharged into a slice chamber and through a slice opening, the discharge wall having a first coefficient of thermal expansion and having a plurality of cross machine direction extending grooves;

a rigid bracket having a bead portion pivotally mounted within one of the plurality of cross machine direction extending grooves;

an elastomeric rod shaped element positioned internal to the bead portion;

a first plurality of cloth layers in a matrix of epoxy extending about the elastomeric rod shaped element and forming a web which is narrower than the bead and which extends from the one groove into the slice chamber;

a second plurality of cloth layers, in the epoxy matrix positioned between the first plurality of cloth layers, so that the first plurality of cloth layers and the second plurality of cloth layers define a vane receiving slot; and wherein the first plurality of cloth layers and the second plurality of cloth layers contain graphite fibers oriented to produce a second coefficient of thermal expansion which is substantially identical to the first coefficient of thermal expansion.

8. The apparatus of claim 7 wherein the first coefficient of thermal expansion is about 6.5 ppm per degree Fahrenheit.

9. The apparatus of claim 7 wherein the web, the elastomeric rod, and the vane receiving slot are centered about a common plane.

10. The apparatus of claim 8 wherein the rigid bracket has a first plurality of holes extending in a cross machine direction above the vane receiving slot and a second plurality of holes extending in a cross machine direction below the vane receiving slot, and a plurality of fasteners extend between the first plurality of holes and the second plurality of holes.

* * * * *